US005125453A

United States Patent [19]

Bertrand et al.

[11] Patent Number: 5,125,453

[45] Date of Patent: Jun. 30, 1992

[54] HEAT EXCHANGER STRUCTURE

[75] Inventors: David W. Bertrand, Richmond, Ind.; Kathleen L. Frazier, Farmington Hills, Mich.; Kevin B. Wise, Connersville, Ind.

[73] Assignee: Ford Motor Company, Dearborn, Mich.

[21] Appl. No.: 812,292

[22] Filed: Dec. 23, 1991

[51] Int. Cl.[5] ..... F28D 1/03; F28F 3/04

[52] U.S. Cl. ..... 165/153; 165/166; 165/167; 165/176

[58] Field of Search ..... 165/153, 166, 167, 176

[56] References Cited

U.S. PATENT DOCUMENTS

| | | | |
|---|---|---|---|
| 3,157,229 | 12/1960 | Hennerberg | 165/167 |
| 3,943,994 | 3/1976 | Cleveland | 165/10 |
| 4,340,114 | 7/1982 | Levy | 165/110 |
| 4,470,455 | 9/1984 | Sacca | 165/167 |
| 4,492,268 | 1/1985 | Uehara et al. | 165/166 |
| 4,509,592 | 4/1985 | Yamada et al. | 165/166 |
| 4,600,053 | 7/1986 | Patel et al. | 165/170 |
| 4,800,954 | 1/1989 | Noguchi et al. | 165/153 |
| 4,932,469 | 6/1990 | Beatenbough | 165/153 |
| 4,967,834 | 11/1990 | Tokizaki et al. | 165/153 |
| 5,062,477 | 11/1991 | Kadle | 165/176 |

FOREIGN PATENT DOCUMENTS

| | | | |
|---|---|---|---|
| 436964 | 4/1912 | France | 165/161 |
| 297998 | 12/1988 | Japan | 165/166 |
| 174898 | 7/1989 | Japan | 165/153 |

*Primary Examiner*—John Rivell
*Assistant Examiner*—L. R. Leo
*Attorney, Agent, or Firm*—Raymond L. Coppiellie; Clifford L. Sadler

[57] ABSTRACT

A plate is disclosed for use in a plate-fin heat exchanger, comprising a generally planar elongated member having a longitudinal rib disposed along the longitudinal length of the member. The plate further includes a first plurality of beads having a height greater than the height of the rib as well as a second plurality of beads having a height approximately equal to the height of the longitudinal rib. The beads are arranged generally in rows having a planar space of predetermined longitudinal length therebetween into which an adjoining row of beads is placed when a pair of identical plates are laminated together in a face-to-face relationship and forming a heat exchanger. A heat exchanger comprising a plurality of stacked plates generally as described above is also disclosed.

20 Claims, 4 Drawing Sheets

HEAT EXCHANGER STRUCTURE

BACKGROUND OF THE INVENTION

1. Field of the Invention

The present invention relates generally to a heat exchanger for an automotive vehicle. More particularly, the present invention relates to a heat exchanger of the plate-fin type wherein each of the plates includes a plurality of bead configurations having different heights.

2. Disclosure Information

Plate-fin heat exchangers are well known in the art. In these types of heat exchangers, a plurality of elongate plates are joined together, such as through a lamination process to define a plurality of passageways for movement of a fluid therethrough. Each of the passageways is formed by the inwardly facing surfaces of a pair of joined plates. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems in motor vehicles.

Various plate designs have been proposed for improving the heat transfer coefficient of the heat exchanger. The heat transfer coefficient can be improved by establishing a multiplicity of pathways for the fluid to flow through so that a greater turbulence and a greater mixing of a fluid to be cooled is obtained. One such proposed plate design is shown in U.S. Pat. No. 4,600,053, assigned to the assignee of the present invention. The plate of the '053 patent includes a plurality of beads formed on each of the pair of plates forming one of the passageways of the fluid in the heat exchanger. The laminated plates include two distinct varieties of beads. A first variety of the beads extends above the surface of the plate and terminates in a flat upper surface. The second variety of beads extends above the surface of the laminated plate and terminates in a curved upper surface. The first and second variety of beads are arranged so that when a pair of the plates are laminated together, the first variety of beads on one of the plates is in bonding contact with the second variety of beads on the other of the pair of plates. In this manner, the heat exchanger has a plurality of flow paths established for the fluid in each of the passageways. However, in assembling a pair of plates to be joined, alignment of the plates could be difficult due to slippage between the plates at the points of contact between the two variety of beads. Furthermore, by establishing bead-to-bead contact, less surface area is available on the outwardly facing side of the plate to contact the fins between the adjacent pairs of plates, resulting in less heat transfer capabilities.

SUMMARY OF THE INVENTION

The present invention overcomes the above problems by providing a plate for use in a plate-fin heat exchanger, comprising a generally planar, elongate member having a longitudinal rib disposed generally parallel to a longitudinal axis of the member. The rib extends generally perpendicularly from the plane of the member a first predetermined distance. The plate also-includes a first plurality of beads extending generally perpendicularly from the plane of the member by a second distance greater than the first predetermined distance as well as a second plurality of beads extending generally perpendicularly from the plane of the member by a distance approximately equal to the first predetermined distance. The longitudinal rib extends along at least a portion of the the longitudinal length of the elongate member so as to divide the member into a first longitudinal portion and a second longitudinal portion, each of the portions having approximately equal total surface areas.

In one embodiment of the present invention, the first plurality of beads are arranged in a plurality of rows separated by planar spaces therebetween, the spaces having a predetermined longitudinal length. The rows are disposed in each of the first and second longitudinal portions of the member such that the row of beads on the first portion is adjacent a planar space of the second longitudinal portion and vice versa.

There is further disclosed herein a heat exchanger comprising a plurality of elongate plate members, each of the plate members structured generally as described above. The plurality of plates of the heat exchanger are joined together to define a plurality of passageways for movement of fluid therebetween, each of the passageways being formed by inwardly facing surfaces of a pair of joined plates. Each pair of joined plates defines a first and second fluid conducting section therebetween and each of the pair of plates is interconnected to an adjacent pair of plates so that fluid may flow through said plurality of plates in the heat exchanger.

It is an object of the present invention to provide a heat exchanger having a plurality of elongate plates configured to reduce plate slippage by establishing bead to flat area contact and which maximizes the fin-to-plate contact surface area for increased heat transfer capabilities.

It is a further object of the present invention to provide a plate for a plate-fin type heat exchanger wherein slippage between pairs of plates is reduced during the manufacturing process and which provides a larger tolerance for misalignment of opposite plates while the reduction in bead count reduces the probability of warp in the plate.

These and other objects, features and advantages of the present invention will become apparent from the drawings, detailed description and claims which follow.

DETAILED DESCRIPTION OF THE PREFERRED EMBODIMENT

Figure 2:
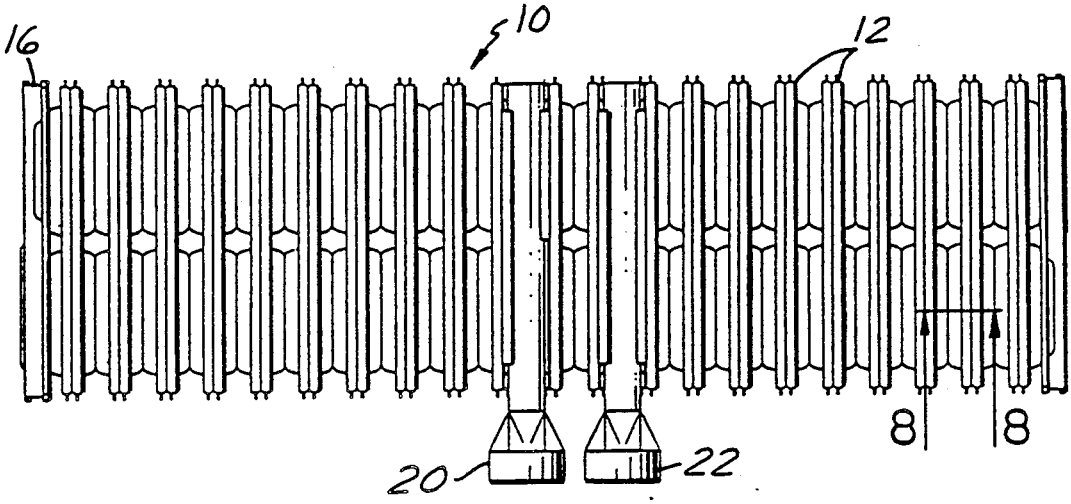
FIG. 2 is a top plan view of the heat exchanger of FIG. 1.
Figure 1:
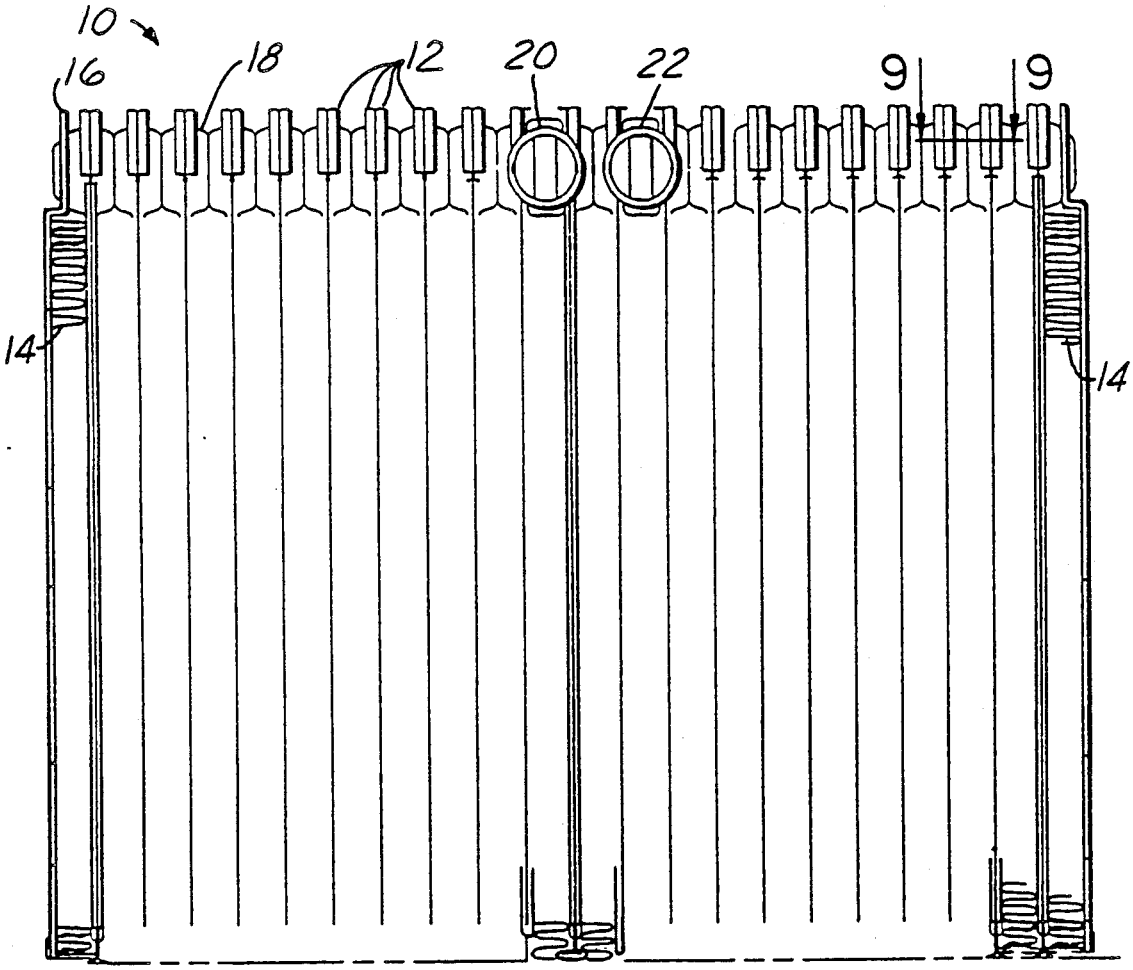
FIG. 1 is a perspective view of a heat exchanger structured in accord with the principles of the present invention.

Referring now to the drawings, FIGS. 1 and 2 show a plate-fin heat exchanger, generally designated by the numeral 10, in the form of an evaporator particularly adapted for use in an automobile air conditioning system. The heat exchanger 10 comprises a stack of formed, elongated plates 12, pairs of which are joined together in a face-to-face relationship so that adjacent pairs provide alternate passageways for the flow of a refrigerant therebetween. The plates may be joined in any of a variety of known processes, such as through brazing or a lamination process. Heat transfer fins 14 are positioned between joined pairs of plates 12 to provide increased heat transfer area as is well known in the art. The joined plate pairs and fin assemblies are contained within endsheets 16.

The heat exchanger 10 includes an inlet port 20 and an outlet port 22 formed within a header 18 at one end of the heat exchanger 10. The header 18 is in direct communication with the passageways between the joined pairs of plates 12 and as will become apparent from the following description, the plates have aligned apertures at one end thereof providing communication between the inlet and outlet ports 20, 22, respectively of header 18. In the heat exchanger of FIGS. 1 and 2, refrigerant is directed into inlet port 20, passed through the paired plurality of joined plates 12 in a known manner. The refrigerant then exits through outlet port 22 to complete the cooling cycle.

The manufacture of the plate and fin heat exchanger 10 is accomplished in a manner well known in the art. The plurality of formed elongated plates are generally formed from an aluminum material coated with an aluminum brazing alloy. The various components used to form the entire unit are made from aluminum stock, then assembled as shown in FIGS. 1 and 2, and passed through a vacuum brazing operation in which the metal brazes together in order to form the completed article. Alternatively, other known processes may be used in the manufacture of the heat exchanger 10. The present invention is not meant to be limited to a specific manufacturing process.

Figure 3:
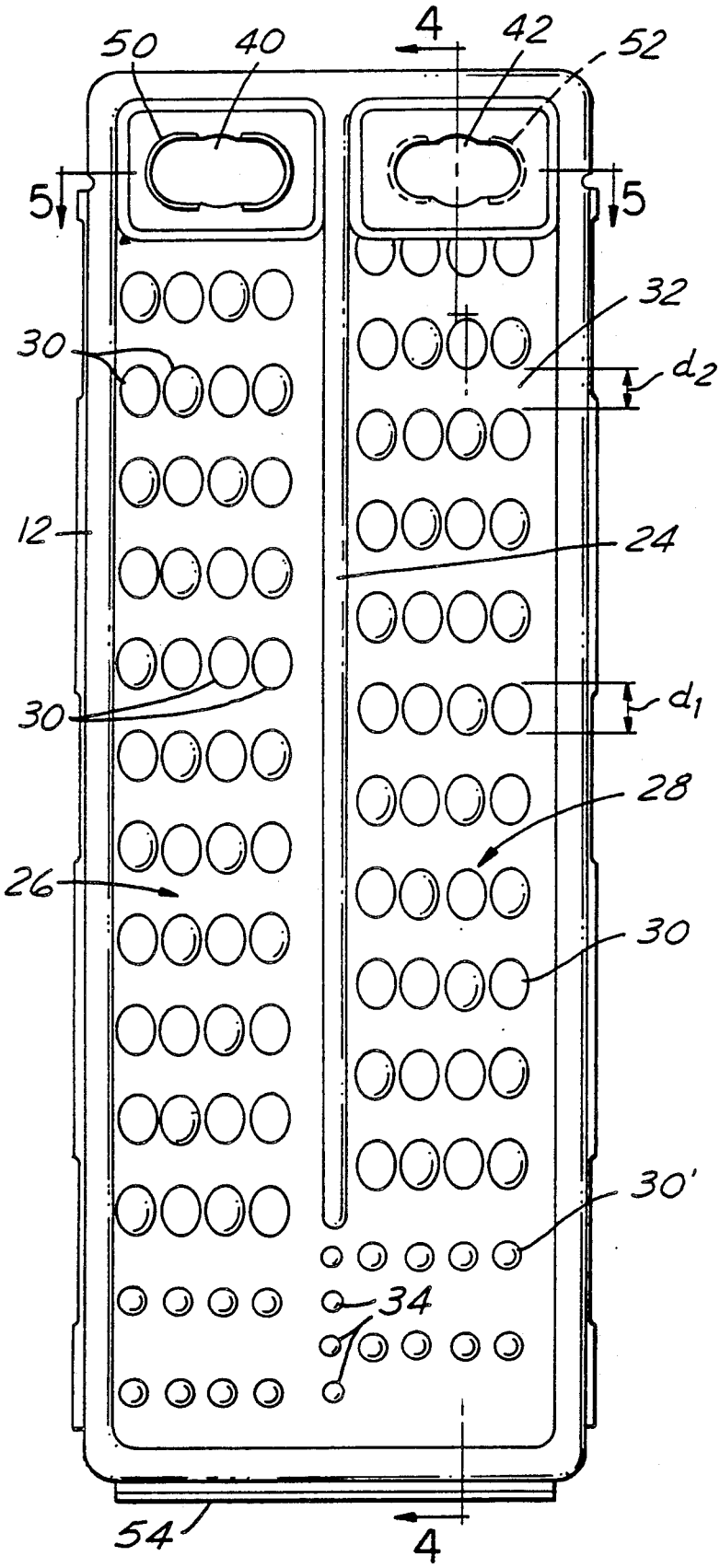
FIG. 3 is an elevational view of a plate for use in the heat exchanger of FIG. 1, structured in accord with the principles of the present invention.
Figure 4:
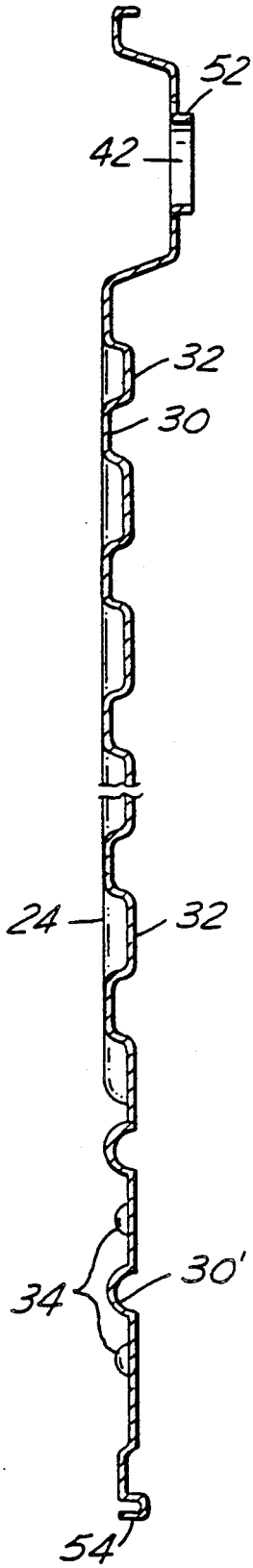
FIG. 4 is a cross-sectional view of the plate of FIG. 3 taken along line 4—4.
Figure 5:
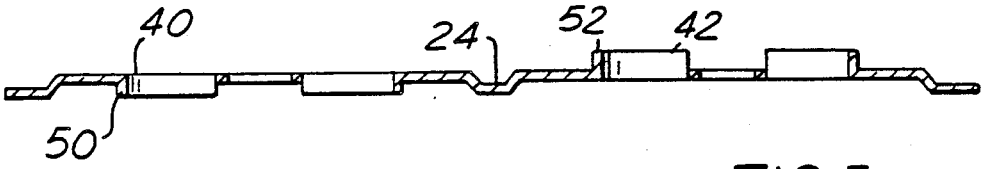
FIG. 5 is a sectional view of the plate of FIG. 3 taken along line 5—5.

As mentioned above, the heat exchanger 10 of the present invention includes a plurality of elongated plates 12 laminated together. These plates are laminated together to define a plurality of passageways generally located in a fluid conducting section of the laminated pair of plates. Referring now to FIGS. 3-5, a plate 12 used in the heat exchanger of FIGS. 1 and 2 includes a longitudinal rib 24 disposed generally parallel to longitudinal axis of the plate. The longitudinal rib 24 has a predetermined height extending perpendicularly from the plane of the plate 12 of between 0.040-0.045 inches. In the embodiment shown in FIG. 3, the rib 24 extends approximately 75 percent of the total length of the plate 12. However, it should be apparent to those skilled in the art that the length of rib 24 could be increased or decreased depending upon the amount of flow to be achieved through plate 12 as will be explained below.

The rib 24 divides the plate 12 into a first fluid conducting portion 26 and a second fluid conducting portion 28. Each of the fluid conducting portions 26, 28 includes approximately equal total surface areas. The fluid conducting portions 26 and 28 define the plurality of passageways between adjoining plates when a pair of identical plates 12 are laminated together, face-to-face. As will become apparent, the fluid enters the pair of joined plates on the first fluid conducting portion 26 of the plate assembly, flows longitudinally toward the bottom of the plate, turns into the second fluid conducting portion 28 to exit at the top of the second fluid conducting portion 28.

Each of the fluid conducting portions 26, 28 of plate 12 includes a plurality of a first variety of beads 30 which extend generally perpendicularly from the plane of the member by a distance greater than the height of the rib 24. In the preferred embodiment, the plurality of beads 30 have a height which is approximately equal to twice the height of the longitudinal rib 24 or about 0.088 inches. As shown in the embodiment in FIG. 3, the beads 30 are arranged in a plurality of rows, four beads per row. A planar space 32 having a distance $d_2$ is formed between each row of the beads 30. The longitudinal length of space 32, $d_2$, is approximately equal to the length of a bead 30. As shown in FIG. 3, the majority of beads 30 are elliptical in configuration, having a major access generally parallel to the longitudinal axis of the plate 12.

Figure 8:
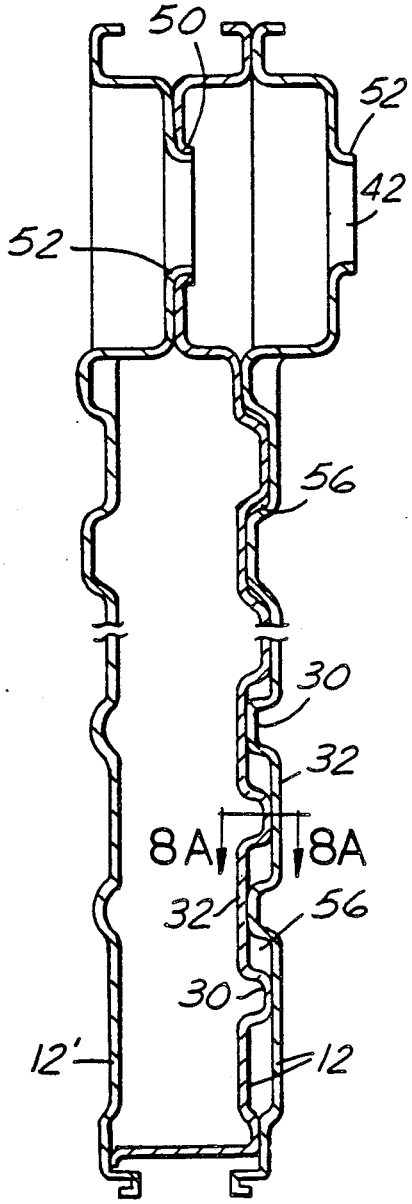
FIG. 8 is a cross-sectional view of a portion of the heat exchanger of FIG. 2 taken along line 8—8.
Figure 8A:
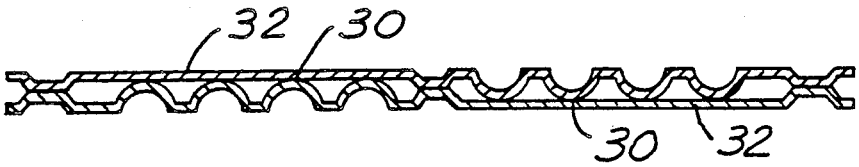
FIG. 8A is a cross-sectional view of a portion of the heat exchanger of FIG. 8 taken along line 8A—8A.

As can further be seen in FIG. 3, each row of elliptical beads 30 on the first fluid conducting portion 26 of plate 12 is adjacent a planar space 32 between rows of elliptical beads 30 of the second fluid conducting portion 28 of plate 12. The beads 30 are arranged in this configuration such that when identical plates are laminated together with the inwardly facing surfaces joined together such as shown in FIGS. 8 and 8A, a row of beads of the first fluid conducting portion rests in the planar spacing 32 between a row of beads of the second fluid conducting portion 28, and vice versa. As such, alignment of the plates during the fabrication process is dramatically improved over prior art heat exchangers because the present invention does not rely on a bead-to-bead contact as known previously. Furthermore, by providing that a row of beads in one fluid conducting portion mate against a planar space of the adjacent fluid conducting portion, a substantial plurality of flow paths are established for the fluid flowing in each fluid conducting section 26, 28 whereby a thorough mixing of the fluid is obtained. Furthermore, the overall surface area on the back side of the plates is increased for adjoining the fins thereto, thus increasing the heat rejection capability of the heat exchanger 10.

The present invention is not meant to be limited by the configuration shown in FIG. 3 wherein each row of beads contains 4 beads. It is contemplated by the present invention that each row may contain as little as two beads or three beads per row. Furthermore, the planar spacing 32 between each row of beads may be increased a distance of between 20 to 35 percent greater than the length of the elliptical beads. This further increases the total amount of surface area for the fins to contact to increase the heat rejection capability of the heat exchanger. Also, as shown in FIG. 3, the plurality of the first variety of beads 30 may be configured either as elliptical or non-elliptical, the non-elliptical beads in FIG. 3 being shown as circular beads 30'.

Figure 6:
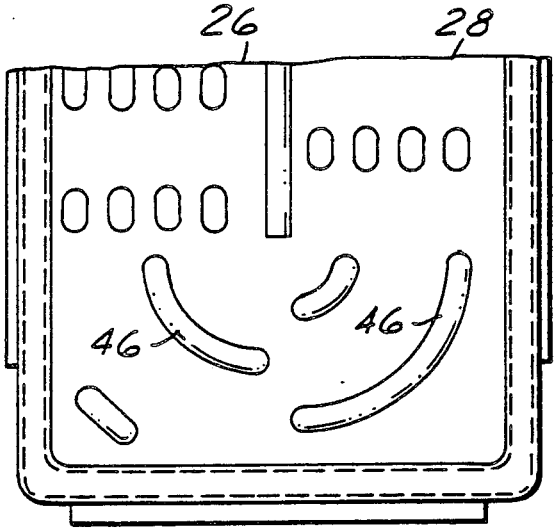
FIGS. 6 and 7 are enlarged views of a portion of the plate of FIG. 3 illustrating alternative embodiments of the bead configuration.
Figure 7:
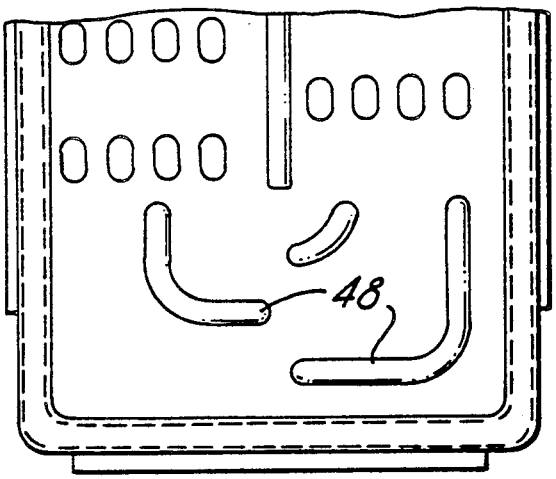

FIGS. 6 and 7 show alternative embodiments of bead configurations wherein the circular beads are replaced by arcuate and L-shaped beads, or vanes, for directing the flow of fluid from the first fluid conducting portion 26 to the second conducting portion 28. As shown in FIGS. 6 and 7, each of the arcuate and L-shaped beads or vanes are configured to have a height approximately twice that of the longitudinal rib so that when identical plates are laminated together in a face-to-face relationship, the arcuate beads 46 and the L-shaped vanes 48 mate or contact the adjoining portion of the opposite plate. This has the advantage of directing the fluid flow from the inlet conducting portion to the outlet conducting portion of the plate 12, which reduces the refrigerant pressure drop and accelerates flow around the turn.

Patterns other than that shown specifically in FIG. 3 may be used for arranging-the first variety and second variety of beads. The single factor required is that when the pair of plates are laminated together, a first variety of beads will come in contact with a planar spacing on the adjoining plate so that a solid bonding contact is formed therebetween when the materials are subsequently laminated together in the vacuum brazing operation.

Referring back to FIG. 3, the plate 12 of the present invention further includes a second variety of beads shown generally at 34. The beads 34 are aligned substantially contiguously with the rib 24 along the remaining longitudinal length of the plate 12. The plurality of beads 34 have a height approximately equal to the height of the rib 24 so that when identical plates are laminated together, the second type of bead 34 contact the second beads 34 on the adjacent plate. In this manner, each pair of laminated plates has a plurality of positively bonded together beads 34 which force fluid to flow therearound. Although the second variety of beads 34 are shown in FIG. 3 as being circular, the beads may take other configurations as well. The present invention is not meant to be limited solely to the circular beads shown in FIG. 3.

The plates 12 further include an inlet port 40 and an outlet port 42 for conducting fluid therethrough in communication with adjacent pairs of plates. Each of the inlet port 40 and outlet port 42 includes a flange 50, 52, respectively, partially surrounding the port circumference. The flanges 50, 52 provide positive engagement between adjoining pairs of plates when the plates are bonded together as an assembly. This can readily be seen in FIGS. 8 and 9 which will be discussed below. The plate 12 also includes a bottom flange 54 configured to also positively engage an adjoining plate to facilitate alignment of the plate assemblies when joined or stacked together.

Figure 9:
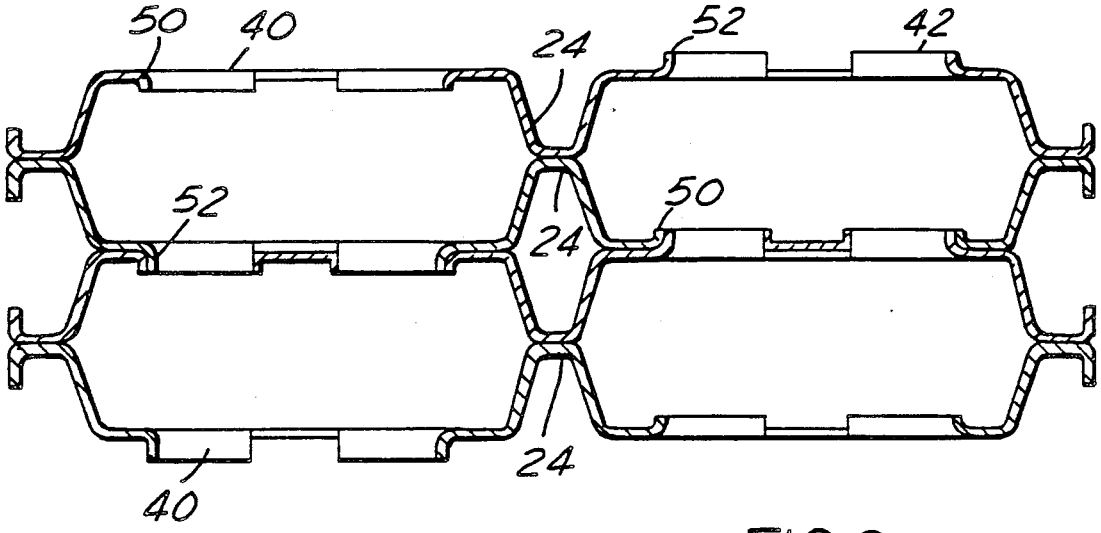
FIG. 9 is a cross-sectional view of a portion of the heat exchanger of FIG. 1 taken along line 9—9.

Referring now to FIGS. 8, 8A and 9, FIGS. 8 and 9 show cross-sectional views of the heat exchanger 10 of FIGS. 1 and 2. FIG. 8 shows a longitudinal cross-section of a pair of laminated plates 12—12 attached to an adjoining one plate 12'. As can be seen in FIG. 8, the laminated plate pair assembly 12—12 defines a plurality of flow passages 56 which thoroughly mix the fluid flowing from one pair of plates to another. As can further be more clearly seen in FIG. 8A, a bead of the first variety 30 is shown as contacting the planar surface 32 of an adjacent plate.

FIG. 9 shows a detailed view of the inlet ports 40 and outlet ports 42 of a plurality of laminated plate pairs. As can be seen, the flange portion 50 of the inlet port positively engages the next successive plate while the flange portion 52 of the outlet port 42 positively engages its mating neighbor. In this manner, alignment of the plates in the heat exchanger is made substantially easier and provides for less slippage between mating pairs of plates which was often a problem in prior art designs.

Various modifications and alterations of the present invention will no doubt occur to those skilled in the art to which this invention pertains. These and all other variations which rely upon the teachings by which this disclosure has advanced the art are properly considered within the scope of this invention as defined by the appended claims.

We claim:

1. A plate for use in a plate-fin heat exchanger, comprising:

a generally planar, elongate member having a longitudinal rib disposed generally parallel to the longitudinal axis of said member and extending generally perpendicularly from the plane of said member a first predetermined distance;

a first plurality of beads extending generally perpendicularly from the plane of said member by a second distance greater than said first predetermined distance; and a second plurality of beads extending generally perpendicularly from the plane of said member by a distance approximately equal to said first predetermined distance.

2. A plate according to claim 1, wherein said longitudinal rib extends substantially the longitudinal length of said member so as to divide said member into a first longitudinal portion and a second longitudinal portion, said portions having approximately equal total surface areas.

3. A plate according to claim 2, wherein the second plurality of beads is substantially aligned contiguously with said rib along a remaining longitudinal length of said member, each bead of said plurality having a predetermined space therebetween.

4. A plate according to claim 2, wherein said first plurality of beads are arranged in a plurality of rows separated by planar spaces therebetween, said planar spaces having a predetermined longitudinal length.

5. A plate according to claim 4, wherein said plurality of rows are disposed on each of said first and second longitudinal portions of said members such that a row of beads on said first portion is adjacent a planar space of said second portion and a row of beads on said second portion is adjacent a planar space of said first portion.

6. A plate according to claim 4, wherein the predetermined length of said planar spaces is approximately equal to the longitudinal length of an adjacent bead of said first plurality of beads.

7. A plate according to claim 4, wherein the predetermined length of said planar spaces is approximately 20%-35% greater than the longitudinal length of an adjacent bead of said first plurality of beads.

8. A plate according to claim 1, wherein said first plurality of beads comprises a plurality of elliptical beads having a major axis disposed generally parallel to the longitudinal axis of said member and a plurality of non-elliptical beads disposed proximate said second plurality of beads.

9. A plate according to claim 8, wherein said plurality of non-elliptical beads are circular.

10. A plate according to claim 8, wherein said plurality of non-elliptical beads are arcuate-shaped.

11. A plate according to claim 2, further including an inlet port disposed in said first portion of said member and an outlet port disposed in said second portion of said member, said ports both being disposed generally at the same end of said member.

12. A plate according to claim 1, wherein said second distance is approximately equal to twice said first predetermined distance.

13. A plate according to claim 2, further including at least one vane operative to direct fluid flow from said first longitudinal portion to said second longitudinal portion.

14. A heat exchanger, comprising:

a plurality of elongate plate members, each plate member of said plurality comprising:

a longitudinal rib disposed generally parallel to the longitudinal axis of said member and extending generally perpendicularly from the plane of said member a first predetermined distance;

a first plurality of beads extending generally perpendicularly from the plane of said member by a second distance greater than said first predetermined distance; and a second plurality of beads extending generally perpendicularly from the plane of said member by a distance approximately equal to said first predetermined distance.

15. A heat exchanger according to claim 14, wherein said longitudinal rib extends substantially the longitudinal length of said member so as to divide said member into a first longitudinal portion and a second longitudinal portion, said portions having approximately equal total surface areas.

16. A heat exchanger according to claim 15, wherein the second plurality of beads is substantially aligned contiguously with said rib along a remaining longitudinal length of said member, each bead of said second plurality having a predetermined space therebetween.

17. A heat exchanger according to claim 15, wherein said first plurality of beads are arranged in a plurality of rows separated by planar spaces therebetween, said planar spaces having a predetermined longitudinal length.

18. A plate according to claim 17, wherein said plurality of rows are disposed on each of said first and second longitudinal portions of said members such that a row of beads on said first portion is adjacent a planar space of said second portion and a row of beads on said second portion is adjacent a planar space of said first portion.

19. A heat exchanger according to claim 18, wherein said plurality of plates are joined together to define a plurality of passageways for movement of fluid therebetween, each of said passageways being formed by inwardly facing surfaces of a pair of joined plates, said pair of plates defining a first and second fluid conducting sections therebetween and each of said pair of plates being interconnected to an adjacent pair of plates so that fluid may flow through said plurality of plates.

20. A heat exchanger according to claim 19, wherein each of said pair of said plurality of plates is of identical design and wherein said first plurality of beads on facing plates of each of said pair are joined directly to said planar spaces of the opposite plate of said pair, and further wherein said second plurality of beads on facing plates are joined directly to said second plurality of beads of said opposite plate.

* * * * *